US009232318B2

(12) United States Patent
Stirnemann

(10) Patent No.: US 9,232,318 B2
(45) Date of Patent: Jan. 5, 2016

(54) HEARING DEVICE WITH A MICROPHONE

(75) Inventor: Alfred Stirnemann, Zollikon (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 13/884,083

(22) PCT Filed: Nov. 12, 2010

(86) PCT No.: PCT/EP2010/067398

§ 371 (c)(1),
(2), (4) Date: May 8, 2013

(87) PCT Pub. No.: WO2011/015674

PCT Pub. Date: Feb. 10, 2011

(65) Prior Publication Data

US 2013/0230199 A1 Sep. 5, 2013

(51) Int. Cl.

| | |
|---|---|
| ***H04R 17/02*** | (2006.01) |
| ***H04R 25/00*** | (2006.01) |
| ***H04R 1/38*** | (2006.01) |
| *H04R 1/08* | (2006.01) |

(52) U.S. Cl.
CPC ..... *H04R 25/402* (2013.01); *H04R 1/38* (2013.01); *H04R 1/083* (2013.01); *H04R 25/405* (2013.01)

(58) Field of Classification Search
USPC ..... 381/355, 356, 338, 357
See application file for complete search history.

(56) References Cited

U.S. PATENT DOCUMENTS

| | | | | |
|---|---|---|---|---|
| 3,995,124 | A * | 11/1976 | Gabr | H04R 1/227 381/186 |
| 4,041,251 | A | 8/1977 | Kaanders | |
| 4,142,072 | A | 2/1979 | Berland | |
| 5,080,743 | A | 1/1992 | Odajima | |
| 5,854,846 | A * | 12/1998 | Beavers | 381/174 |
| 6,788,796 | B1 | 9/2004 | Miles et al. | |
| 6,876,749 | B1 | 4/2005 | Killion et al. | |
| 2003/0179894 | A1 | 9/2003 | Saltykov | |
| 2007/0058826 | A1 | 3/2007 | Sawamoto et al. | |
| 2007/0177752 | A1 | 8/2007 | Kargus | |

FOREIGN PATENT DOCUMENTS

| | | | |
|---|---|---|---|
| DE | 19640796 | A1 | 4/1998 |
| EP | 1443798 | A2 | 8/2004 |
| EP | 1467593 | A2 | 10/2004 |
| EP | 2229005 | A1 | 9/2010 |
| GB | 1173623 | | 12/1969 |

OTHER PUBLICATIONS

International Search Report for PCT/EP2010/067398 dated Jan. 10, 2011.

Written Opinion for PCT/EP2010/067398 dated Jan. 10, 2011.

* cited by examiner

*Primary Examiner* — Davetta W Goins

*Assistant Examiner* — Amir Etesam

(74) *Attorney, Agent, or Firm* — Pearne & Gordon LLP

(57) ABSTRACT

The present invention relates to a hearing device comprising a microphone (1) wherein the microphone (1) comprises a first opening (8), a second opening (9) and at least three compartments (2, 3, 4), a first membrane (6) being arranged between the first and the second compartment (2; 3) and a second membrane (7;) at least partly covering the third compartment (4), wherein the second and the third compartments (3, 4) are connected in communicative manner via a canal (11).

17 Claims, 8 Drawing Sheets

HEARING DEVICE WITH A MICROPHONE

Figure 1:
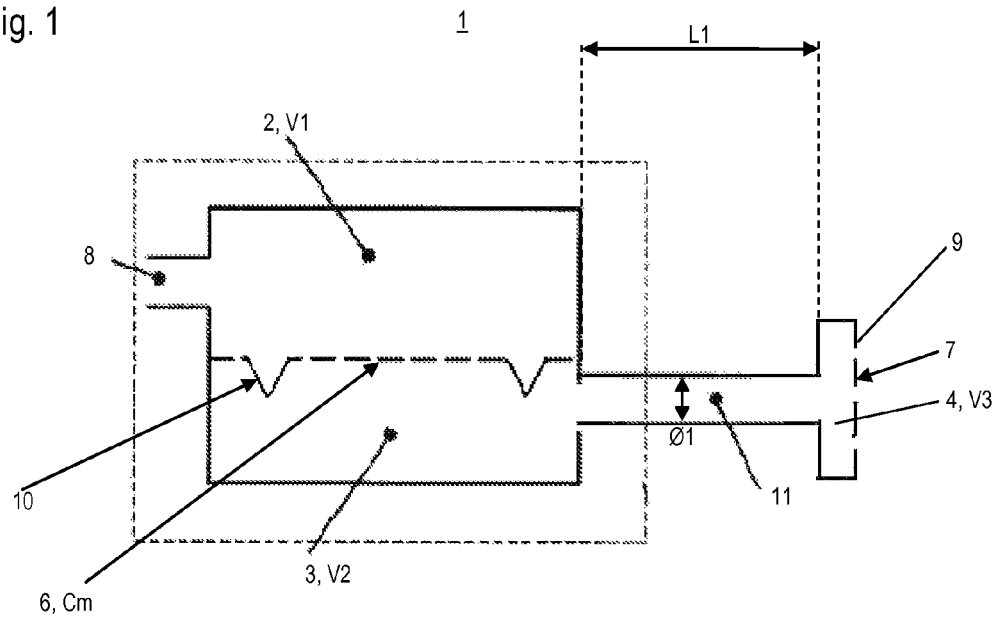

The present invention relates to a hearing device according to the pre-characterizing part of claim 1.

A behind-the-ear hearing device (BTE) comprises a microphone that is arranged outside of the concha. As a consequence, the directional characteristic resulting from the geometry of the concha and the pinna of the auricle of a person wearing such a BTE hearing device is lost.

It is known either to use two microphones or to use a differential microphone having two sound inlets to generate a directional characteristic, also known under the term "beam forming".

The following documents describe known teachings of beam forming such as e.g. U.S. Pat. No. 4,142,072, U.S. Pat. No. 6,876,749, US 2003/0179894 and U.S. Pat. No. 4,041,251.

In particular, EP 1 443 798 provides a hearing device with a BTE microphone arrangement whereat beam forming provides for substantially constant amplification independent of the direction of arrival of an acoustical signal at a present determined frequency and provides above such frequency directivity so as to re-establish a head-related-transfer-function of the individual.

In addition, EP 1 467 593 discloses a directional microphone with a housing comprising two membranes. The membranes are arranged such that the housing is divided into three compartments.

Furthermore, DE 19 640 796 discloses a protection device at the sound inlet in order to protect the hearing device from dirt (i.e. cerumen).

One object of the present invention is to provide a hearing device which is cost-efficient to manufacture.

At least this object is solved by the features of a hearing device given in claim 1 according to the present invention. Further embodiments of the invention are given in dependent claims.

The present invention relates to a hearing device comprising a microphone wherein the microphone comprises a first opening, a second opening and at least three compartments. Further, a first membrane is arranged between the first and the second compartment and a second membrane at least partly covers the third compartment, wherein the second and the third compartments are connected in communicative manner via a canal. Thereby, the natural directional characteristic resulting from the geometry of the concha and the pinna can be imitated.

A further embodiment of the present invention features that the first compartment comprises the first opening and that the third compartment comprises the second opening where the second membrane is located.

In a further embodiment of the present invention the first compartment comprises the first opening. Furthermore, the hearing device comprises at least a fourth compartment wherein the second membrane is arranged between the third compartment and the fourth compartment and that the fourth compartment comprises the second opening.

In a further embodiment of the present invention the hearing device comprises a fifth compartment, a further canal and a third membrane. The further canal connects the fifth compartment and the first compartment. The third compartment comprises the second opening where the second membrane is located and the third membrane at least partly covers the first opening of the fifth compartment.

In a further embodiment of the present invention the third compartment and the fifth compartment are of a same or of a different volume size.

A further embodiment of the present invention the canal has an acoustical mass of >300 kg/m$^4$.

A further embodiment a distance between the two openings is in the range of 5 mm to 15 mm.

In a further embodiment of the present invention the second membrane has an acoustical compliance ratio with respect to the first membrane in a range of 0.3 to 3 according to a formula:

$$Ka = \frac{C_1}{C_m};$$

wherein $C_m$ is the compliance of the first membrane below its resonance frequency and C1 is the compliance of the second membrane. Thereby, a suitable stiffness of the first membrane can be selected. The stiffness can be understood as the reciprocal value of the acoustical compliance.

In a further embodiment of the present invention the third membrane has another acoustical compliance ratio with respect to the second membrane in a range of >1.1 to 1.5 according to a formula:

$$Kb = \frac{C_2}{C_1};$$

wherein C1 is the compliance of the second membrane below its resonance frequency and C1 is the compliance of the third membrane.

In a further embodiment of the present invention the second membrane comprises a plastic film, e.g. made out of polyester, or a metal foil made out of titanium or aluminium.

A further embodiment of the present invention is that the third membrane comprises a plastic film, e.g. made out of polyester, or a metal foil made out of titanium or aluminium.

In a further embodiment of the present invention the plastic film or the metal foil has a thickness in the range of 2 μm to 20 μm, in particular in the range of 5 μm to 15 μm.

In a further embodiment of the present invention at least one of the membranes comprises a passage. Thereby, atmospheric pressure compensation can be achieved.

In a further embodiment of the present invention a second microphone is acoustically connected to the first microphone via a third canal. The third canal comprises a first canal part and a second canal part.

In a further embodiment of the present invention the second microphone comprises only means for fastening and tensioning the second membrane. Thereby, a cost efficient standard microphone can be used.

In a further embodiment of the present invention a signal of the first microphone and another signal of the second microphone are electrically combined. Thereby, the two microphones can be electrically combined in using only one A/D-converter.

A sound signal is picked up in function of deflection of the first membrane or in function of deflection of the first and the second membrane or in function of deflection of the first, the second and the third membrane or by later superimposing of picked up sound signals. This applies to all of the previously described embodiments.

Herewith, it is noted that each of the openings are operationally connected to one of the compartments. By the term "operationally connected" has to be understood that each of both openings are acoustically connected or connected in communicative manner to a corresponding compartment. The openings can be sound inlets.

Figure 2:
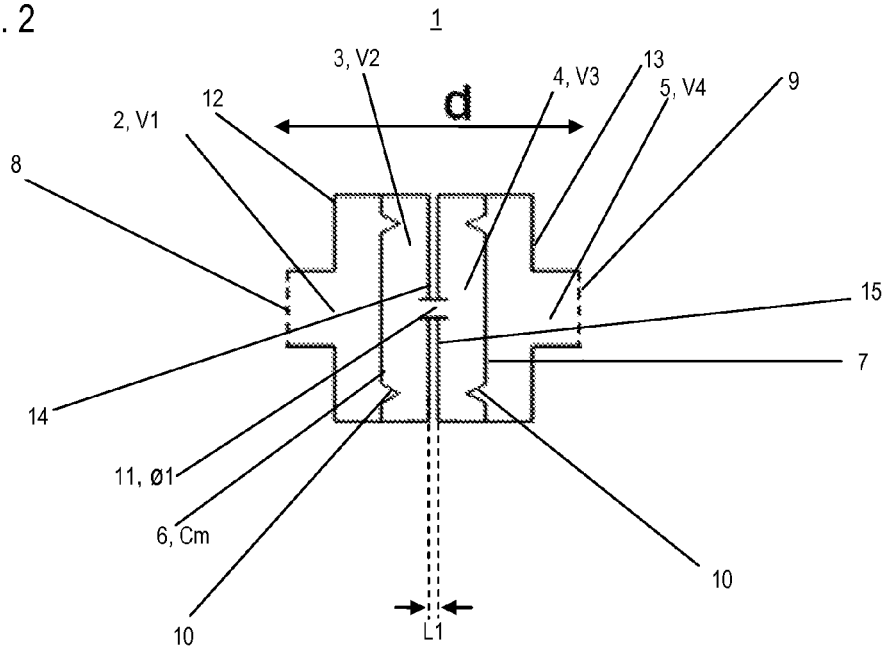
Figure 3:
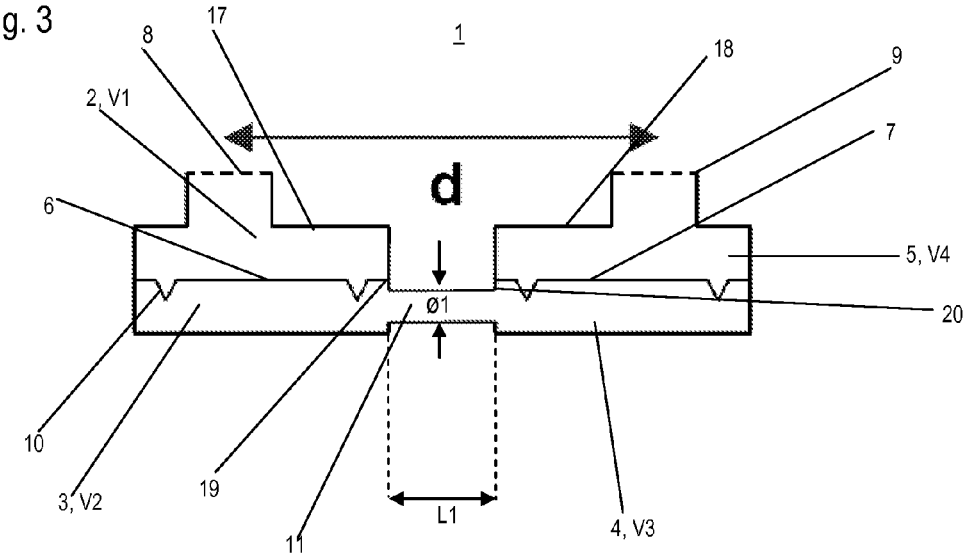
Figure 4:
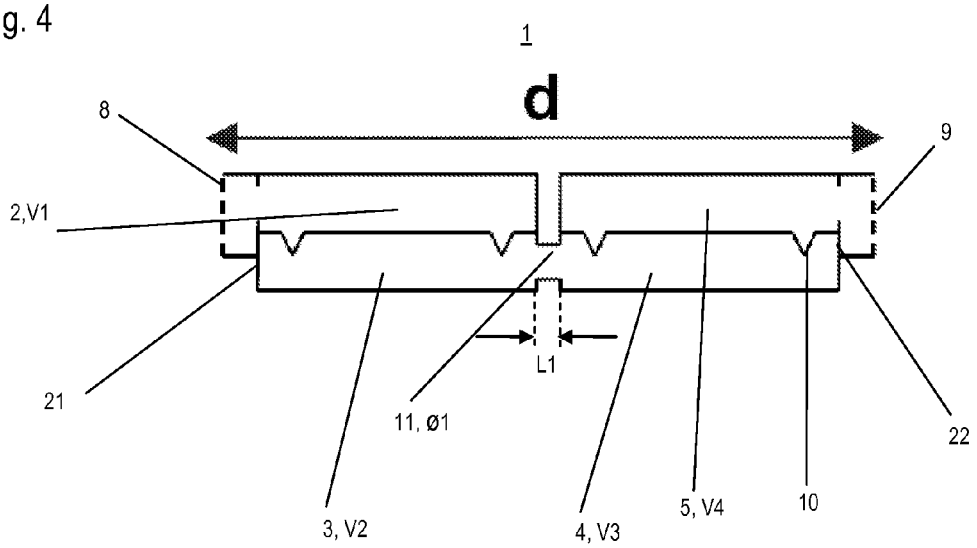
Figure 5:
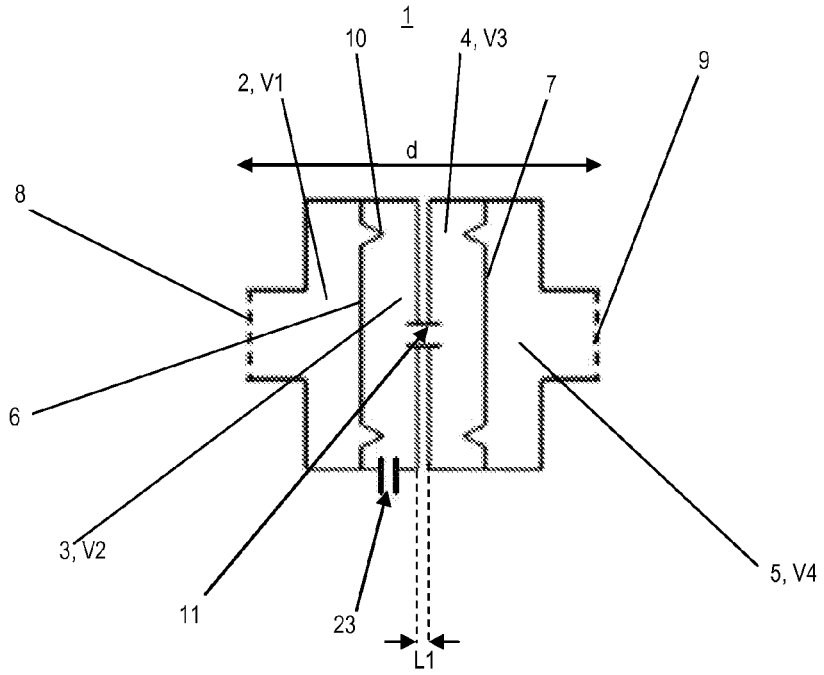
Figure 6:
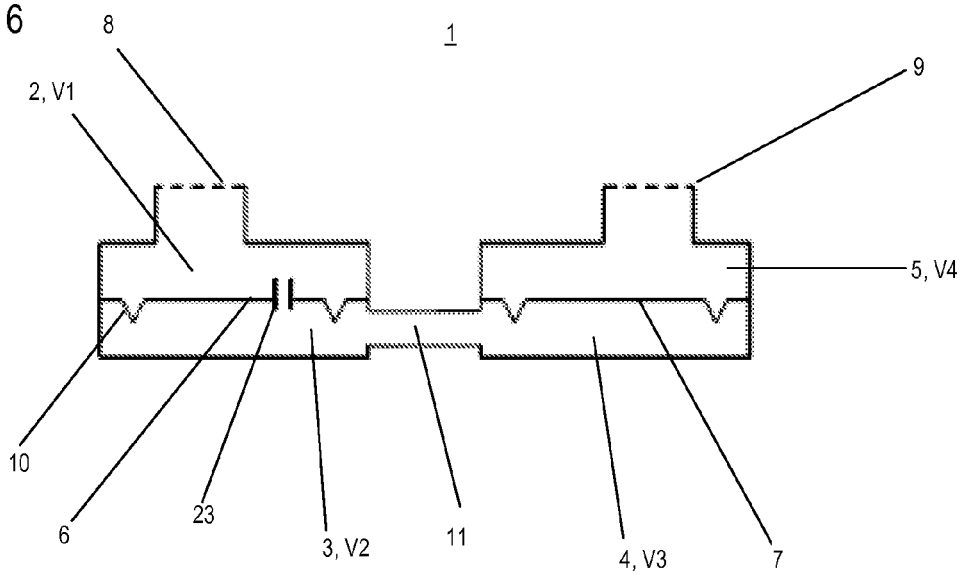
Figure 7:
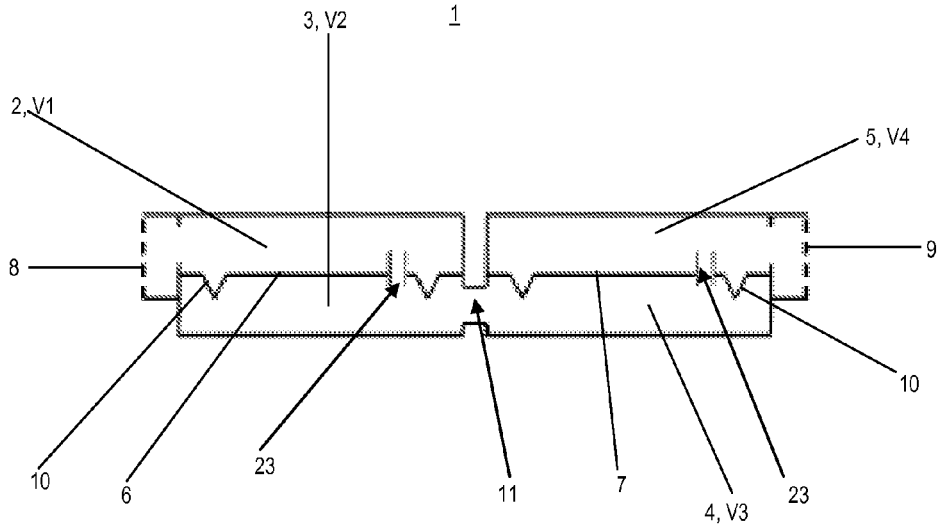
Figure 8:
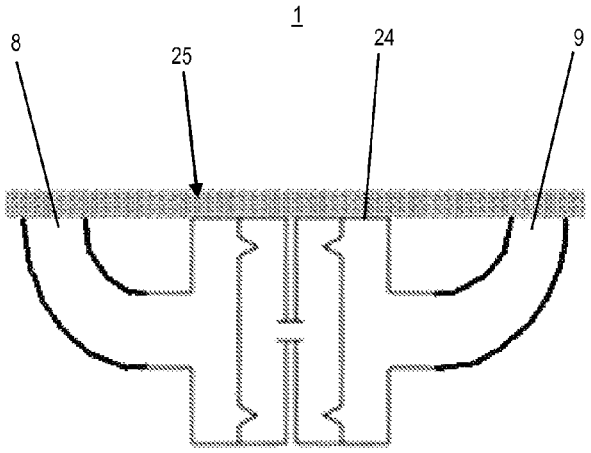
Figure 9:
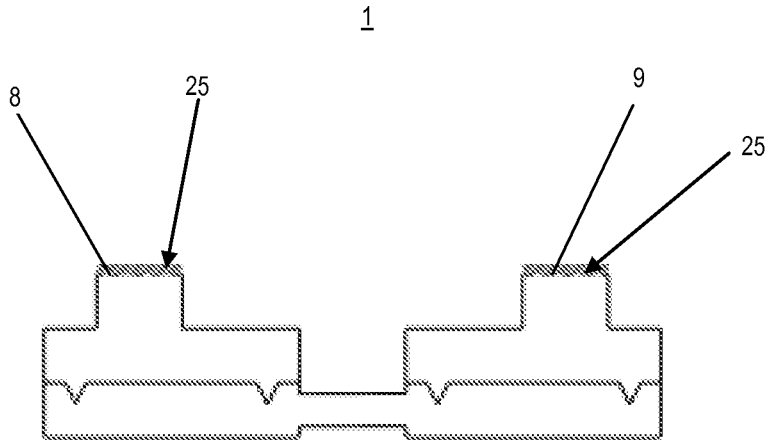
Figure 10:
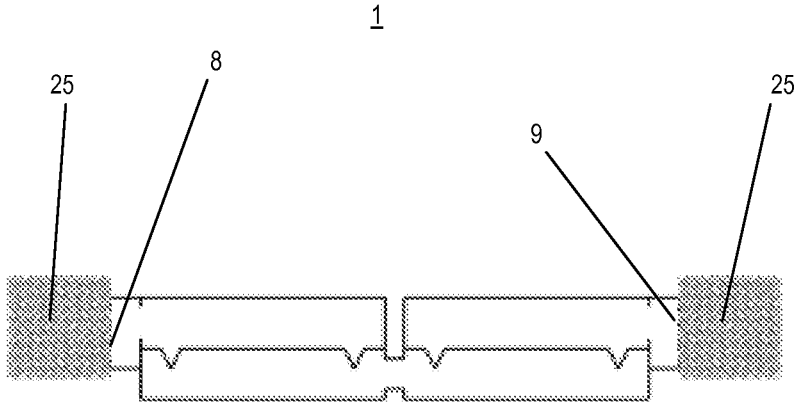
Figure 11:
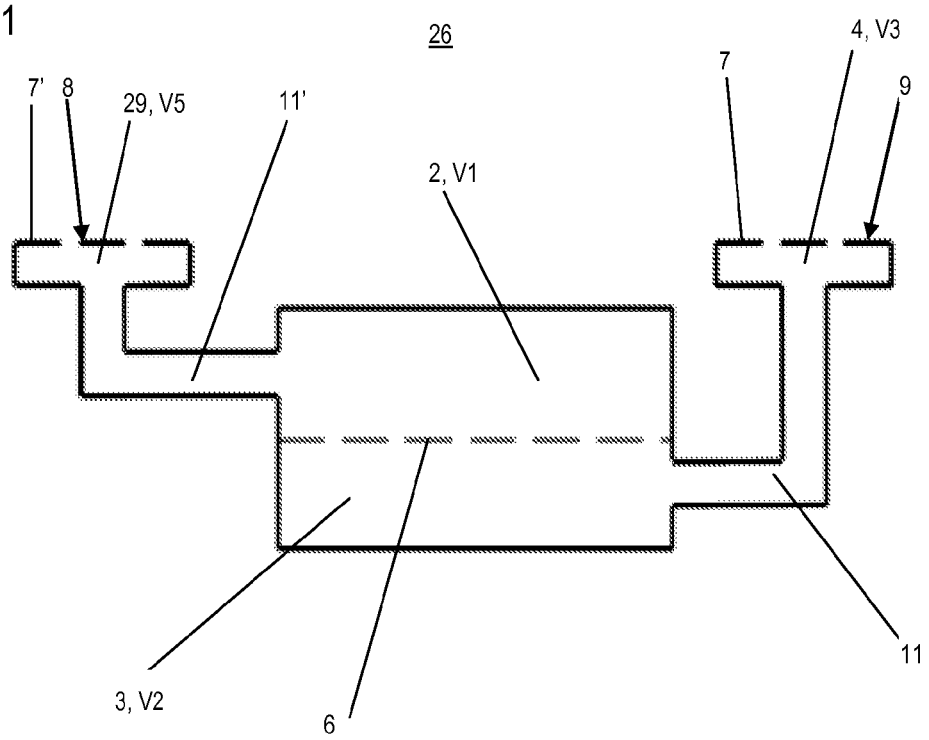
Figure 12:
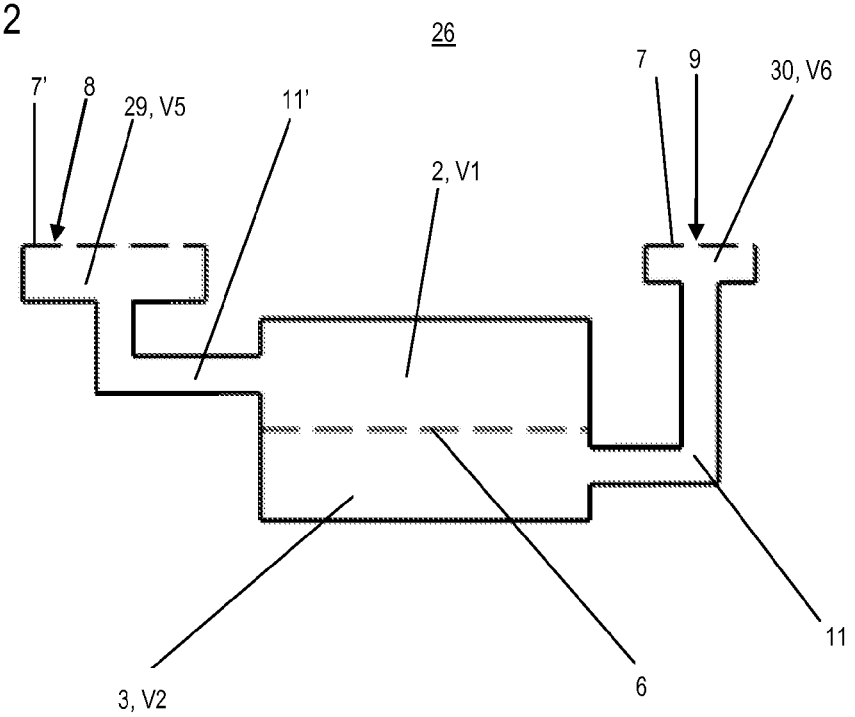
Figure 13:
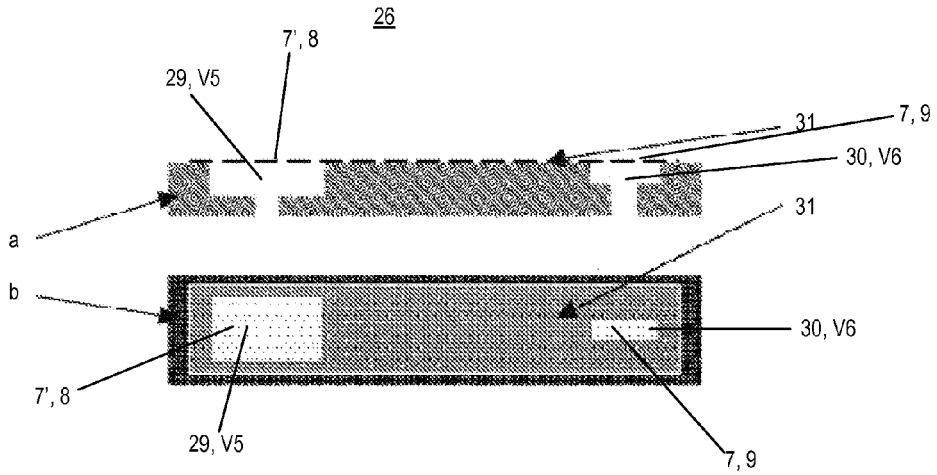
Figure 14:
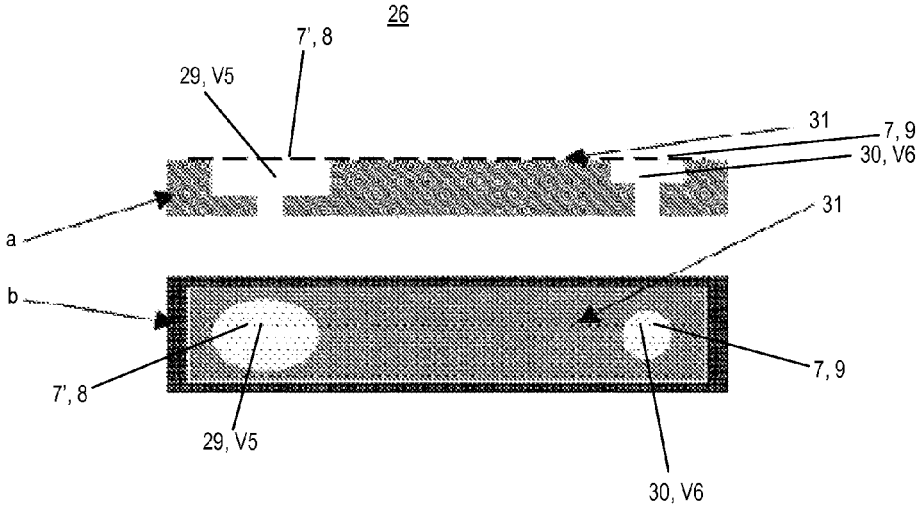
Figure 15:
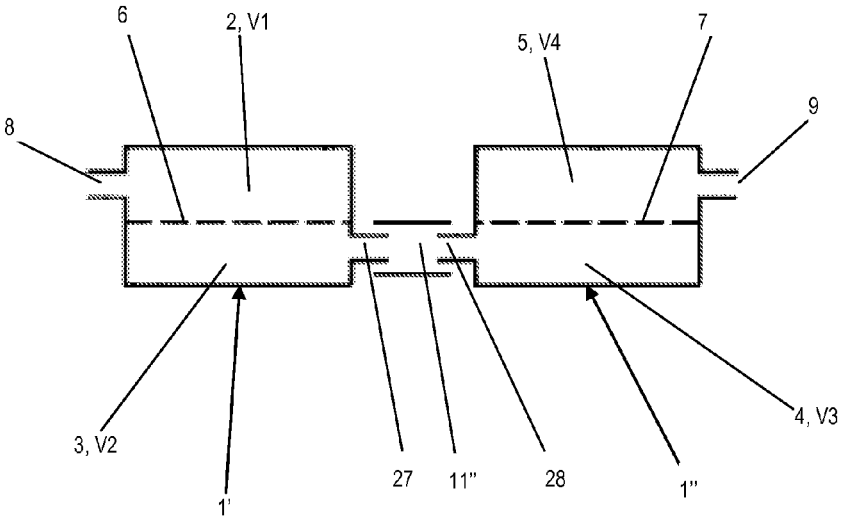
Figure 16:
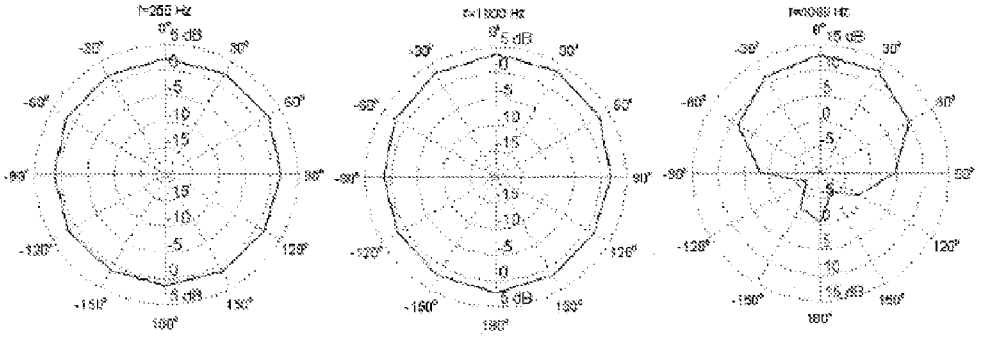

The present invention is further explained by referring to drawings showing exemplified embodiments:

FIG. 1 schematically, shows a first embodiment according to the present invention;

FIG. 2 schematically, shows a further embodiment according to the present invention;

FIG. 3 schematically, shows another embodiment according to the present invention;

FIG. 4 schematically, shows another embodiment according to the present invention;

FIG. 5 schematically, shows another embodiment of the present invention according to FIG. 2;

FIG. 6 schematically, shows another embodiment of the present invention according to FIG. 3;

FIG. 7 schematically, shows another embodiment of the present invention according to FIG. 4;

FIG. 8 schematically, shows another embodiment of the present invention according to FIG. 2;

FIG. 9 schematically, shows another embodiment of the present invention according to FIG. 3;

FIG. 10 schematically, shows another embodiment of the present invention according to FIG. 4;

FIG. 11 schematically, shows another embodiment of the present invention;

FIG. 12 schematically, shows another embodiment of the present invention according to FIG. 11;

FIG. 13 schematically, shows another embodiment of the present invention according to FIG. 12;

FIG. 14 schematically, shows another embodiment of the present invention according to FIG. 12;

FIG. 15 schematically, shows another embodiment of the present invention; and FIG. 16 shows measured directional characteristic at different frequencies.

Herewith, it is noted that the same reference signs used in different figures refer to the same technical features.

FIG. 1 schematically, shows a first embodiment according to the present invention with a microphone 1 comprising at least three compartments 2, 3, 4. A first membrane 6 is arranged between the first compartment 2 and the second compartment 3. The first compartment 2 forms a first volume V1. The first membrane 6 has a defined microphone compliance Cm below its resonance frequency depending on the material and the tension of the first membrane 6. A second membrane 7 at least partly delimits the third compartment 4. A first opening 8 is arranged at the side of the first compartment 2. The third compartment 4 comprises a second opening 9. The openings 8, 9 can be sound inlets. The first opening 8 is operationally connected to the first compartment 2. The second opening 9 is operationally connected to the third compartment 4. The term "operationally connected" has to be understood as acoustically connected or connected in communicative manner, respectively. The elastic membranes 6, 7 are tensioned to the microphone 1 by fastening means 10 like for instance holders, supports or carriers. A canal 11 of length L1 and of diameter Ø1 connects in communicative manner the second and the third compartments 3, 4 to each other. The second compartment 3 forms a second volume V2 and the third compartment 4 forms a third volume V3.

FIG. 2 schematically, shows a further embodiment according to the present invention. The reference signs already introduced in FIG. 1 correspond to those used in FIG. 2. The difference to the embodiment of FIG. 1 is that the microphone 1 comprises four compartments 2, 3, 4, 5. The fourth compartment 5 has a fourth volume V4. The first volume V1 and the fourth volume V4 are open to the outside resp. to the atmosphere. The openings 8, 9 are arranged approximately in the middle of a corresponding longitudinal side 12, 13, of the T-shaped first and fourth compartments 2, 5. The canal 11 is formed as a narrowing between the second compartment 3 and the third compartment 4. Furthermore, the canal 11 is located approximately on a further corresponding longitudinal side 14, 15, of the second compartment 3 resp. of the third compartment 4. The openings 8, 9 are arranged at a distance d from one to another. The distance d between the openings 8, 9 is between about 5 mm to about 15 mm.

In a special example, it is also conceivable that the first compartment 2, the first membrane 6 and the second compartment 3 can be located in a commercially available microphone, e.g. a gradient microphone, wherein the third compartment 4, the second membrane 7 and the fourth compartment 5 are located in a further microphone. In this case, the two microphones (not shown in FIG. 2) are connected in communicative manner via the canal 11.

FIG. 3 schematically, shows a further embodiment according to the present invention. The reference signs already introduced in FIGS. 1 and 2 correspond to the reference signs of FIG. 3. The difference to FIGS. 1 and 2 is that the openings 8, 9 are arranged at upper sides 17, 18 of the corresponding first resp. fourth compartment 2, 5.

Furthermore, the elongated canal 11 of diameter Ø1 is located approximately on a corresponding short side 19, 20 of the second compartment 3 resp. of the third compartment 4.

FIG. 4 schematically, shows another embodiment according to the present invention. The reference signs already introduced in FIGS. 1 to 3 correspond to the reference signs of FIG. 4. The difference to the embodiments depicted in FIGS. 1 to 3 is that the openings 8, 9 are located in the region of short sides 21, 22 of the first compartment 2 and of the second compartment 3 resp. of the third compartment 4 and of the fourth compartment 5.

FIG. 5 schematically, shows another embodiment according to the present invention according to FIG. 2. The reference signs already introduced in FIG. 2 correspond to the ones of FIG. 5. A passage 23 is arranged in the second compartment 3. The passage 23 serves for atmospheric pressure compensation. The passage 23 is arranged to the outside of the microphone 1. The passage 23 has a size of about 5 μm to about 35 μm, particularly about 30 μm to about 35 μm. The passage 23 is dimensioned such that a cut-off frequency of about 20 Hz is achieved.

FIG. 6 schematically, shows another embodiment according to the present invention according to FIG. 3. The reference signs already introduced in FIG. 3 correspond to the ones of FIG. 6. The passage 23 is located in the first membrane 6 of the microphone 1 such that the second compartment 3 is connected to the first compartment 2 wherein the first opening 8 is arranged. This allows for atmospheric pressure compensation between the inside and the outside of the microphone.

FIG. 7 schematically, shows another embodiment according to the present invention according to FIG. 4. Each of the membranes 6, 7 comprises one passage 23.

FIG. 8 schematically, shows another embodiment of the present invention according to FIG. 2. The openings 8, 9 are located at a top side 24 of the microphone 1 and are covered by a protection membrane 25. The protection membrane 25 is made out of a soft, porous material, like for example textile.

FIG. 9 schematically, shows another embodiment of the present invention according to FIG. 3. The difference to FIG. 8 is that only the openings 8, 9 are covered by the corresponding protection membrane 25.

FIG. 10 schematically, shows another embodiment of the present invention according to FIG. 4. As in FIG. 9, the openings 8, 9 are covered by the corresponding protection membrane 25. The protection membrane 25 is made out of a soft, porous material, like for example textile.

FIG. 11 schematically, shows another embodiment of the present invention. The reference signs already introduced in the afore-mentioned FIGS. 1 to 10 correspond to the reference signs of FIG. 11. A gradient microphone 26 for example comprises the second compartment 3 and the third compartment 4 being connected in communicative manner via the canal 11. The volume of the second compartment 3 forms the second volume V2 and the volume of the third compartment 4 forms the third volume V3. The first membrane 6 is arranged between the first compartment 2 and the second compartment 3. The first compartment 2 is connected in communicative manner via a further canal 11' to a fifth compartment 29. The fifth compartment 29 forms a fifth volume V5. The third Volume V3 and the fifth volume V5 are of the same volume size. The third compartment 4 is covered by the second membrane 7. Furthermore, the second membrane 7 covers the second opening 9 of the third compartment 4. The fifth compartment 29 is covered by a third membrane 7' such that the first opening 8 of the fifth compartment 29 is covered by the third membrane 7'.

The second membrane 7 and the third membrane 7' are made out of different materials, possibly each of a different thickness and a different tension. Furthermore, the third volume V3 and the size of the fifth volume V5 are of a same volume size.

The second membrane 7 can be made out of plastic, e.g. polyester. The membrane 7' can be a metal foil, e.g. a titanium or aluminium foil. It is also conceivable that the third membrane 7' is made out of plastic, e.g. polyester and the second membrane 7 is a metal foil, e.g. a titanium or aluminium foil.

FIG. 12 schematically, shows another embodiment of the present invention according to FIG. 11. The reference signs already introduced in FIG. 11 are the same as in FIG. 12. The difference to FIG. 11 is that the fifth volume V5 is bigger than a sixth volume V6. Thus, the fifth compartment 29 is bigger than a sixth compartment 30. It is also conceivable that the fifth compartment 29 and therewith its fifth volume V5 is smaller than the sixth compartment 30 having the sixth volume V6. The membranes 7, 7' can be made out of the same material. The material either can be plastic, e.g. polyester, or the material can be a metal foil, e.g. a titanium or aluminium foil.

Another difference to FIG. 11 is that although the second membrane 7 and the third membrane 7' may be out of the same material, the surface area of the membranes may be different.

FIG. 13 schematically, shows another embodiment of the present invention according to FIG. 12, wherein a) represents a partial side view and b) represents a partial top view of the microphone 26. The difference to FIG. 12 is that the second and the third membranes 7, 7' covering the corresponding openings 8, 9 form one continuous membrane 31. The shape of the fifth compartment 29 and of the sixth compartment 30 is substantially rectangular.

FIG. 14 schematically, shows another embodiment of the present invention according to FIG. 12, wherein a) represents a partial side view and b) represents a partial top view of the microphone 26. The reference signs already introduced in FIG. 12 are the same as for FIG. 14. The difference to FIG. 12 is that the second and the third membranes 7, 7' covering the corresponding openings 8, 9 form one continuous membrane 31. The shape of the fifth compartment 29 and of the sixth compartment 30 is substantially oval.

FIG. 15 schematically, shows another embodiment of the present invention. A first microphone 1' and a second microphone 1" are connected in communicative manner via a third canal 11". The canal 11" comprises a first canal part 27 and a second canal part 28. The first canal part 27 is arranged to the second compartment 3 and the second canal part 27 is arranged adjacent to the third compartment 4. The first microphone 1' comprises the first opening 8 and the second microphone comprises the second opening 9. The second microphone 1" comprises only means for fastening and tensioning (not depicted in FIG. 15) the second membrane 7. It can be a commercially available cost-efficient microphone. It is also conceivable that the second microphone 1" can be a standard microphone. Thereby, the signals of the microphones 1', 1" can be electrically combined so that only one single analog-digital converter (A/D-converter) is required.

FIG. 16 shows measured directional characteristic at a frequency of 250 Hz, 1000 Hz and at 4000 Hz which has been obtained with an arrangement according to FIG. 15.

A sound signal is picked up in function of deflection of the first membrane or in function of deflection of the first and the second membrane or in function of deflection of the first, the second and the third membrane or by later superimposing of picked up sound signals. This applies to all of the previously described examples of the FIGS. 1 to 16.

The invention claimed is:

1. A hearing device comprising a microphone (1; 1'; 26) wherein the microphone (1; 1'; 26) comprises a first opening (8), a second opening (9) and at least three compartments (2; 3; 4; 5; 29; 30), a first membrane (6) being arranged between the first and the second compartment (2; 3) and a second membrane (7) at least partly covering the third compartment (4), wherein the second and the third compartments (3, 4) are connected in communicative manner via a canal (11; 11"), characterized in that the second membrane (7) has an acoustical compliance ratio (Ka) with respect to the first membrane (6) in a range of 0.3 to 3 according to a formula (I):

$$Ka = \frac{C_1}{C_m}; \tag{I}$$

wherein Cm is the compliance of the first membrane (6) below its resonance frequency and C1 is the compliance of the second membrane (7).

2. A hearing device according to claim 1, characterized in that the second membrane (7) comprises a plastic film made out of polyester or a metal foil made out of titanium or aluminium.

3. A hearing device comprising a microphone (1; 1'; 26) wherein the microphone (1; 1'; 26) comprises a first opening (8), a second opening (9) and at least three compartments (2; 3; 4; 5; 29; 30), a first membrane (6) being arranged between the first and the second compartment (2; 3) and a second membrane (7) at least partly covering the third compartment (4), wherein the second and the third compartments (3, 4) are connected in communicative manner via a canal (11; 11"), characterized in that the second membrane (7) comprises a plastic film made out of polyester or a metal foil made out of titanium or aluminium, and the plastic film or the metal foil has a thickness (a) in the range of 2 μm to 20 μm, in particular in the range of 5 μm to 15 μm.

4. A hearing device according to claim 1, characterized in that at least one of the membranes comprises a passage (23).

5. A hearing device comprising a microphone (1; 1'; 26) wherein the microphone (1; 1'; 26) comprises a first opening (8), a second opening (9) and at least three compartments (2; 3; 4; 5; 29; 30), a first membrane (6) being arranged between the first and the second compartment (2; 3) and a second membrane (7) at least partly covering the third compartment (4), wherein the second and the third compartments (3, 4) are connected in communicative manner via a canal (11; 11"), characterized in that a second microphone (1") is acoustically connected to the first microphone (1; 1') via a third canal (11"), the third canal (11") comprising a first canal part (27) and a second canal part (28).

6. A hearing device according to claim 5, characterized in that the second microphone (1") comprises only means for fastening and tensioning the second membrane (7).

7. A hearing device according to claim 5, characterized in that a signal of the first microphone (1; 1') and another signal of the second microphone (1") are electrically combined.

8. A hearing device according to claim 1, wherein the hearing device is a behind-the-ear hearing device.

9. A hearing device according to claim 1, wherein the at least three compartments, the first membrane, and the second membrane are arranged asymmetrically.

10. A hearing device according to claim 1, wherein the second membrane (7) covers the second opening (9).

11. A hearing device according to claim 1, wherein the first opening (8) is acoustically connected to the first compartment (2) and the second opening (9) is acoustically connected to the third compartment (4).

12. A hearing device according to claim 1, characterized in that the canal (11; 11") has an acoustical mass (Ma) of >300 $kg/m^4$.

13. A hearing device according to claim 1, characterized in that a distance (d) between the two openings (8; 9) is in the range of 5 mm to 15 mm.

14. A hearing device comprising a microphone (1; 1'; 26) wherein the microphone (1; 1'; 26) comprises a first opening (8), a second opening (9) and at least three compartments (2; 3; 4; 5; 29; 30), a first membrane (6) being arranged between the first and the second compartment (2; 3) and a second membrane (7) at least partly covering the third compartment (4), wherein the second and the third compartments (3, 4) are connected in communicative manner via a canal (11; 11"), characterized in that the hearing device comprises at least a fourth compartment (29), and in that the fourth compartment (29) comprises the first opening (8), and characterized in that the hearing device comprises a further canal (11') and a third membrane (7'), wherein the further canal (11') connects the fourth compartment (29) and the first compartment (2), the third compartment (4) comprising the second opening (9) where the second membrane (7) is located and the third membrane (7') at least partly covers the first opening (8) of the fourth compartment (29).

15. A hearing device according to claim 14, characterized in that the third compartment (4) and the fourth compartment (29) are of a same volume size (V3; V5) or of a different volume size (V5; V6).

16. A hearing device according to claim 14, characterized in that the third membrane (7') comprises a plastic film made out of polyester or a metal foil made out of titanium or aluminium.

17. A hearing device according to claim 14, characterized in that the third membrane (7') has another acoustical compliance ratio (Kb) with respect to the second membrane (7) in another range of 1.1 to 1.5 according to a formula (II):

$$Kb = \frac{C_2}{C_1}; \qquad \text{(II)}$$

wherein C1 is the compliance of the second membrane (7) below its resonance frequency and C2 is the compliance of the third membrane (7').

* * * * *